US010550485B2

(12) United States Patent
Jung et al.

(10) Patent No.: US 10,550,485 B2
(45) Date of Patent: Feb. 4, 2020

(54) PIPE-TYPE ELECTROLYSIS CELL

(71) Applicant: Techwin Co, Ltd., Cheongju, Chungcheongbuk-do (KR)

(72) Inventors: Boong Ik Jung, Chungcheongbuk-do (KR); Jung Sik Kim, Chungcheongbuk-do (KR); Hyun Su Shin, Daejeon (KR); Min Yong Kim, Chungcheongbuk-do (KR)

(73) Assignee: Techwin Co., Ltd., Cheongju, Chungcheonbuk-do (KR)

( * ) Notice: Subject to any disclaimer, the term of this patent is extended or adjusted under 35 U.S.C. 154(b) by 289 days.

(21) Appl. No.: 15/623,995

(22) Filed: Jun. 15, 2017

(65) Prior Publication Data

US 2017/0283962 A1 Oct. 5, 2017

Related U.S. Application Data

(63) Continuation of application No. PCT/KR2015/011466, filed on Oct. 28, 2015.

(30) Foreign Application Priority Data

Dec. 23, 2014 (KR) ..... 10-2014-0187430

(51) Int. Cl.

| | |
|---|---|
| ***C25B 9/06*** | (2006.01) |
| ***C25B 11/02*** | (2006.01) |
| ***C25B 1/26*** | (2006.01) |
| ***C25B 9/02*** | (2006.01) |
| ***C25B 1/34*** | (2006.01) |
| ***C25B 9/18*** | (2006.01) |

(52) U.S. Cl.

CPC ..... *C25B 9/063* (2013.01); *C25B 1/26* (2013.01); *C25B 1/34* (2013.01); *C25B 9/02* (2013.01); *C25B 9/18* (2013.01); *C25B 11/02* (2013.01)

(58) Field of Classification Search

CPC .... C25B 1/26; C25B 1/34; C25B 9/02; C25B 9/063; C25B 9/18; C25B 11/02

See application file for complete search history.

(56) References Cited

U.S. PATENT DOCUMENTS

| | | | | |
|---|---|---|---|---|
| 4,392,937 | A * | 7/1983 | Schmitt | C25B 9/18 204/269 |
| 2003/0205482 | A1* | 11/2003 | Allen | C25B 9/06 205/630 |
| 2015/0041311 | A1* | 2/2015 | Mathe | C02F 1/4674 204/253 |

FOREIGN PATENT DOCUMENTS

| | | | |
|---|---|---|---|
| GB | 1396019 | A | 5/1975 |
| KR | 10-2013-0110429 | A | 10/2013 |
| KR | 10-1329046 | B1 | 11/2013 |
| KR | 10-1366343 | B1 | 2/2014 |
| KR | 10-1412721 | B1 | 6/2014 |
| KR | 10-1466371 | B1 | 11/2014 |
| WO | 9425643 | A1 | 11/1994 |

(Continued)

*Primary Examiner* — Ciel P Thomas

(74) *Attorney, Agent, or Firm* — Nelson Mullins Riley & Scarborough LLP; Kongsik Kim

(57) ABSTRACT

Disclosed is a pipe-type electrolysis cell including: a pair of terminal electrodes including an outer electrode and an inner electrode that are electrically connected to each other at respective first ends thereof and separated from each other at respective second ends thereof; and a bipolar electrode installed between the terminal electrodes and electrically insulated the terminal electrodes.

20 Claims, 18 Drawing Sheets

(56) References Cited

FOREIGN PATENT DOCUMENTS

| | | | |
|---|---|---|---|
| WO | 2004097072 | A1 | 11/2004 |
| WO | 2011-115370 | A2 | 9/2011 |

* cited by examiner

"A"

"B"

PIPE-TYPE ELECTROLYSIS CELL

CROSS-REFERENCE TO RELATED APPLICATIONS

This application is a continuation application of International Application No. PCT/KR2015/011466 filed on Oct. 28, 2015, which claims priority to Korean Application No. 10-2014-0187430 filed on Dec. 23, 2014, which applications are incorporated herein by reference.

TECHNICAL FIELD

The present invention relates to a pipe-type electrolysis cell and, more particularly, to a pipe-type electrolysis cell having a reduced size, thereby overcoming a constraint of installation space and reducing the manufacturing cost while providing advantages of a tube type electrolysis cell.

BACKGROUND ART

As a typical example of an electrolytic cell for electrolyzing an electrolyte solution such as sea water, salt water, or the like, there is a pipe-type electrolysis cell.

The pipe-type electrolysis cell has a pipe-type electrode typically consisting of an outer pipe and an inner pipe. The inner pipe is a combined bipolar tube electrode in which one portion serves as an anode and the other portion serves as a cathode. The outer pipe includes an anode portion, a cathode portion, and an insulating spacer disposed at a center portion thereof, in which the anode portion and the cathode portion are disposed to be opposite to the anode and the cathode of the inner pipe. Alternatively, both of the inner pipe and the outer pipe may be monopolar electrodes having one polarity.

In the pipe-type electrolytic cell, when DC power is applied between the anode and the cathode to cause electrolysis while an electrolyte solution flows along the surfaces of the inner pipe and the outer pipe, electrolyzed water is produced.

Electrolysis can be used for various process such as production of chlorine, sodium hydroxide, sodium hypochlorite, and the like through electrolysis of sea water or salt water, production of hydrogen and oxygen through electrolysis of water, production of various organic compounds through electrolysis of carbon dioxide, decomposition of ammonia or organic substances, production of acidic water and alkaline water, and the like.

Among these processes, chemical equations of a typical electrolysis process to produce sodium hypochlorite from sea water or salt water are shown below.

$$2Cl^- \rightarrow Cl^2 + 2e^- \quad \text{Anodic reaction:}$$

$$2H_2O + 2e^- \rightarrow 2OH^- + H_2\uparrow \quad \text{Cathodic reaction:}$$

$$Cl_2 + 2NaOH \rightarrow NaOCl + NaCl + H_2O \quad \text{Bulk reaction:}$$

Chlorine ($Cl_2$) is produced at the anode side through oxidation of chlorine ions, and hydrogen gas ($H_2$) and hydroxyl ions (OH—) are produced at the cathode side through water splitting. Hydroxyl ions (OH—) produced at the cathode side react with sodium ions (Na+) in a bulk phase to produce sodium hydroxide (NaOH), and the sodium hydroxide (NaOH) reacts with chlorine ($Cl_2$), in a bulk phase, produced at the anode to produce sodium hypochlorite (NaOCl). Sodium hypochlorite (NaOCl) produced in this way is used to lower biological activity, or used in various applications for sterilization (disinfection) and cleaning.

Hardness materials such as Ca and Mg contained in an electrolyte solution form scale on a cathode electrode through chemical reactions described below, during electrolysis, and the accumulated scale lowers electrolysis efficiency, resulting in an increase in cell voltage, impedes the flow of a fluid, and causes physical damage attributable to short-circuiting between electrodes in extreme cases.

Scale formation reaction: $HCO_3^- + NaOH \rightarrow CO_3^{2-} + H_2O_2O + Na^+$ $Ca^{2+}$ or $Mg^{2+} + CO_3^{2-} \rightarrow CaCO_3$ or $MgCO_3$ $Ca^{2+}$ or $Mg^{2+} + 2OH- \rightarrow Ca(OH)_2$ or $Mg(OH)_2$ A conventional technology of preventing accumulation of scale is disclosed in Korean Patent Application Publication No. 10-2006-0098445 (Electronic Water Treatment System And Method For Controlling The Same). According to this technology, an anode bar serving as an anode is installed inside a pipeline through which a fluid flows, a housing surrounding the anode bar serves as a cathode, and an electric current flows through the anode bar to form electromagnetic fields in a fluid passage, thereby preventing generation of scale. That is, when a fluid flows along the fluid passage in which electromagnetic fields are formed, since free electrons are sufficiently generated due to the electromagnetic fields, inorganic substances contained in the fluid become structurally stable, which prevents scale formation.

The conventional technology requires generation of uniform density of electromagnetic fields to suppress generation of scale. However, in the case in which the flow rate of fluid, flowing along the fluid passage, is not constant but fluctuates, it is difficult to maintain uniform density of electromagnetic fields. For this reason, it is difficult to effectively impede scale formation. That is, the conventional art, which prevents scale formation through an electrical method, requires an advanced technology to precisely control the intensity of current in accordance with the flow rate of fluid. Therefore, it is not easy to substantially perfectly prevent scale formation, and thus it is necessary to mechanically remove generated scale.

To solve the problem of this technology, Korean Patent Application No. 10-2012-0032399 (titled "Pipe-type Electrolysis Cell) is disclosed. The "Pipe-type Electrolysis Cell" provides an electrolytic cell in which corners of electrodes in a fluid passing zone are eliminated to prevent scale formation on the surface of a cathode during operation of the electrolytic cell. The construction of the pipe-type electrolysis cell is shown in FIGS. 1 to 6.

With reference to FIGS. 1 to 6, according to a conventional art, a pipe-type electrolysis cell 10 includes an insulating spacer 11 disposed at a middle portion thereof, an anode outer pipe 12 disposed on one side of the insulating spacer 11, and a cathode outer pipe 13 disposed on the other side of the insulating spacer 11. A cathode inner pipe (not shown) is installed inside the anode outer pipe 12, and an anode inner pipe 13' is installed inside the cathode outer pipe 13. An insulating bushing 14, a spiral block 15, a fixing bushing 16, and an inlet/outlet connection nipple 17 are assembled with an end of the electrolysis cell 10 by a coupling member 18. Due to the use of the spiral block 15, when a fluid flows in and out of the electrolysis cell 10 through a spiral hole 15*a* formed in the spiral block 15, since a fluid passage has a spiral form, the fluid can flow at a constant uniform flow rate. This prevents hydrogen gas $H_2$ and oxygen gas $O_2$ generated during an electrolytic reaction from being locally concentrated in a specific portion, which removes an intervening factor of surface reaction attributable to the gases and enables uniform reaction. Therefore, it is possible to obtain effects of an improvement in efficiency of electrolytic reaction and an increase in life span of the electrolysis cell.

In addition, a plurality of electrolysis cells 10, each cell being the pipe-type electrolysis cell 10 having the structure described above, is connected in series with each other to form a unit module 20 as illustrated in FIG. 1. Therefore, it is possible to easily provide a module having desired capacity. Furthermore, a plurality of unit modules 20 may be connected in parallel with each other to increase the electrolysis capacity, as illustrated in FIG. 2.

The electrolysis module consisting of the pipe-type electrolysis cells 10 has a higher withstand voltage and a simpler structure than conventional cube-shaped electrolysis modules using a flat plate electrode. Furthermore, since this electrolysis module has an improved velocity profile, it is possible to minimize scale accumulation and facilitate hydrogen emissions.

However, in the case of the conventional pipe-type electrolysis cell, since only one surface of the electrode is involved in an electrolytic reaction, a large amount of material is likely to be wasted. In addition, since the pipe-type electrolysis cell requires a large installation space, it is difficult to use the pipe-type electrolysis cell in small places. In addition, since the number of parts of the pipe-type electrolysis cell is large and assembling of the parts is complicated, the manufacturing cost is increased.

In addition, in the case of the conventional pipe-type electrolysis cell, current distribution is non-uniform over the electrode. Therefore, when the conventional pipe-type electrolysis cells are arranged in multiple stages, it is difficult to obtain uniform reaction, the life span of the electrode is shortened, and excessive heat is generated.

SUMMARY

Accordingly, the present invention has been made keeping in mind the above problems occurring in the related art, and an object of the present invention is to provide a pipe-type electrolysis cell that can reduce the manufacturing cost of an electrolysis module by reducing the number of parts thereof and simplifying a manufacturing method, and can overcome a space constraint problem by having a size that is about a half of the size of conventional electrolysis cells having the same capacity, while providing advantages of conventional technologies that are proven to be safe.

That is, the present invention is devised in consideration of the above problems, and is intended to provide an improved pipe-type electrolysis cell having a reduced size while maintaining an electrolysis performance, thereby saving an installation space and the manufacturing cost.

In addition, another object of the invention is to improve uniformity and efficiency of reaction by enabling uniform current distribution throughout pipe-type electrolysis cells arranged in multiple stages.

In order to accomplish the above objects, the present invention provides a pipe-type electrolysis cell including: a pair of terminal electrodes including an outer electrode and an inner electrode having respective first ends electrically connected to each other and respective second ends separated from each other; and a pipe-type bipolar electrode installed between the terminal electrodes and electrically insulated from the terminal electrodes.

The pipe-type electrolysis cell may further include: an insulation unit supporting the separated second ends of the terminal electrodes and connecting the terminal electrodes to each other; and a spiral block combined with the connected first ends of the terminal electrodes and provided with a spiral guide hole through which a fluid passes.

The terminal electrodes may include a connection plate that supports and connects the first ends of the inner electrode and the outer electrode and which is provided with a fluid passing hole communicating with a channel formed between the inner electrode and the outer electrode, thereby guiding a fluid to the channel.

The pipe-type electrolysis cell may further include terminal insulating spacers provided to respective ends of the bipolar electrode to electrically insulate and space the bipolar electrode from the connection plate, the inner electrode, and the outer electrode.

Either one or both of an outside surface of the outer electrode having a pipe shape and an inside surface of the inner electrode having a pipe shape are plated with a metal having a high electrical conductivity, wherein the outside surface and the inside surface are not involved in an electrolytic reaction.

The connection plate provided with the fluid passing hole, and the outer and inner electrodes may be connected through welding.

The fluid passing holes formed in the connection plate may be through holes formed to be aligned with spiral guide holes formed in the spiral block.

A positioning guide pin may be formed to protrude from an outside surface of the connection plate, the spiral block may be combined with the outside surface of the connection plate, and the spiral block may be provided with a plurality of spiral guide holes that are arranged in a circumferential direction so as to correspond to the fluid passing holes of the connection plate.

The spiral block may be provided with a positioning hole into which the positioning guide pin is inserted when the spiral block is combined with the connection plate such that the spiral guide holes are well aligned with the fluid passing holes of the connection plate.

The insulation unit may include: an outer insulating spacer provided on an outside surface of the bipolar electrode at a middle portion in a longitudinal direction; and an inner insulating spacer provided inside the bipolar electrode at the middle portion in the longitudinal direction.

The pipe-type electrolysis cell may further include: an insulation unit supporting and connecting the separated second ends of the terminal electrodes to each other; and a spiral block combined with the connected first ends of the terminal electrodes and provided with a spiral guide hole through which a fluid passes.

The outer insulating spacer may include: a plurality of protrusions formed on an inside surface thereof and arranged at regular intervals in a circumferential direction thereof, at a middle portion in a longitudinal direction thereof, the protrusions being in contact with the outside surface of the middle electrode; and a pair of electrode connection portions that are provided at respective ends thereof and into which the outer electrodes are inserted, the electrode connection portions having an inner diameter larger than that of the middle portion of the outer insulating spacer such that an inside surface of the electrode connection portion and an inside surface of the middle portion of the outer insulating spacer form a step shape.

The inner insulating spacer may include: a plurality of protrusions arranged at a middle portion of the middle electrode in a longitudinal direction, arranged at regular intervals in a circumferential direction, and formed to protrude from an outside surface of the inner insulating spacer; and a pair of electrode connection portions provided at respective ends thereof and having an outer diameter smaller than that of the middle portion of the inner insulating spacer such that an outside surface of the electrode connection portion and the outside surface of the middle portion of the inner insulating spacer form a step form, in which the electrode connection portions are inserted into the inner electrodes.

The pipe-type electrolysis cell may further include a connection pipe or an inlet/outlet connection nipple combined with the first ends of the terminal electrodes, and used to connect one of the pipe-type electrolysis cells to another pipe-type electrolysis cell, wherein the connection pipe or the inlet/outlet connection nipple is structured such that a bottom surface thereof is sloped upwards toward an end of the connection pipe or the inlet/outlet connection nipple.

According to the present invention, since the pipe-type electrolysis cell has a structure in which both the outside surface and the inside surface of the bipolar electrode are involved in electrolysis, electrolysis efficiency doubles compared with conventional electrolysis cells having the same size. Therefore, it is possible to reduce the manufacturing cost and the size of an electrolysis module manufactured by connecting a plurality of pipe-type electrolysis cells.

In addition, when constructing a multi-stage electrolysis cell, one surface of an electrode, which is not involved in an electrolytic reaction, is plated with a metal having a high electrical conductivity. This has an effect of uniformizing current distribution over the entire area of the electrode, resulting in improvements in uniformity and efficiency of the electrolytic reaction.

The pipe-type electrolysis cell according to the present invention can reduce an installation space therefore in half compared with conventional electrolysis cells that require a large installation space while maintaining the same electrolysis performance, thereby reducing the cost.

DETAILED DESCRIPTION

Figure 1:
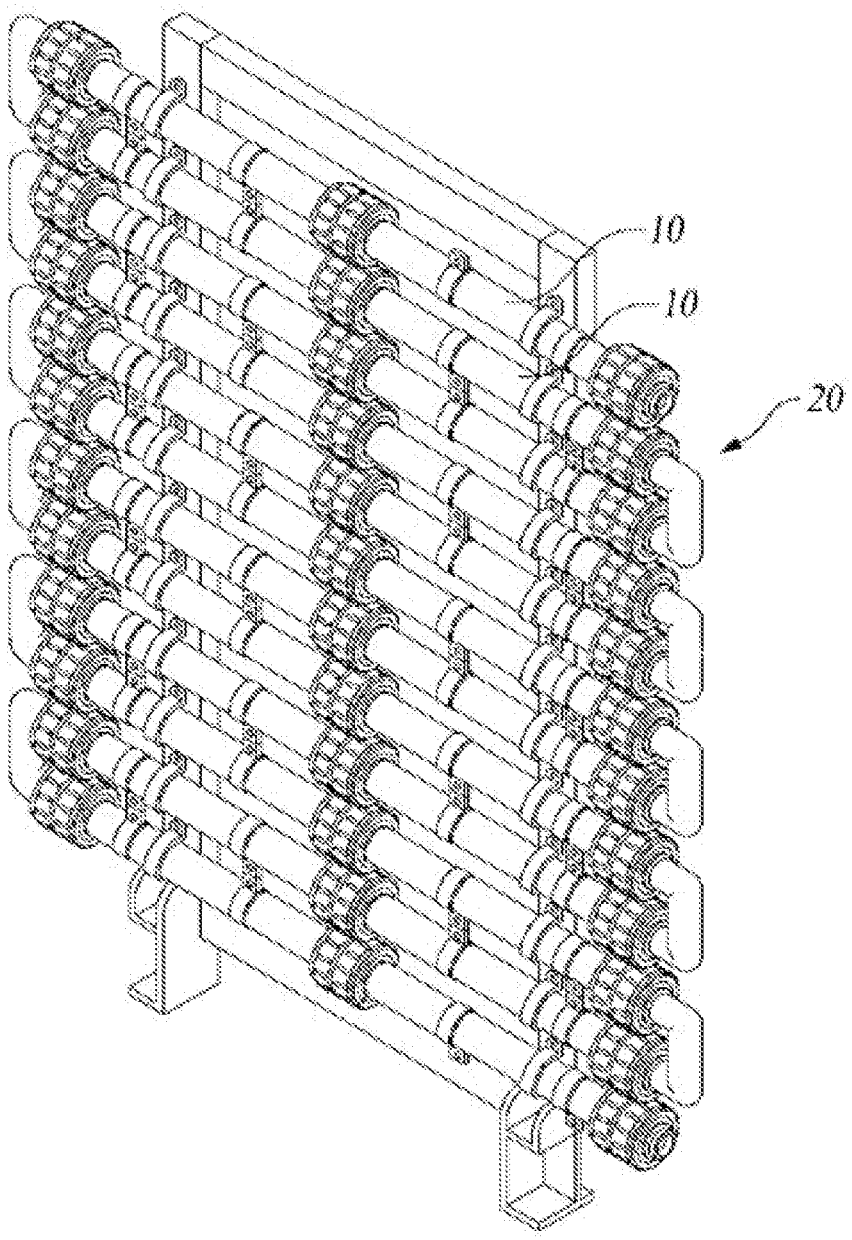
FIG. 1 is a perspective view of a conventional unit electrolysis module.
Figure 2:
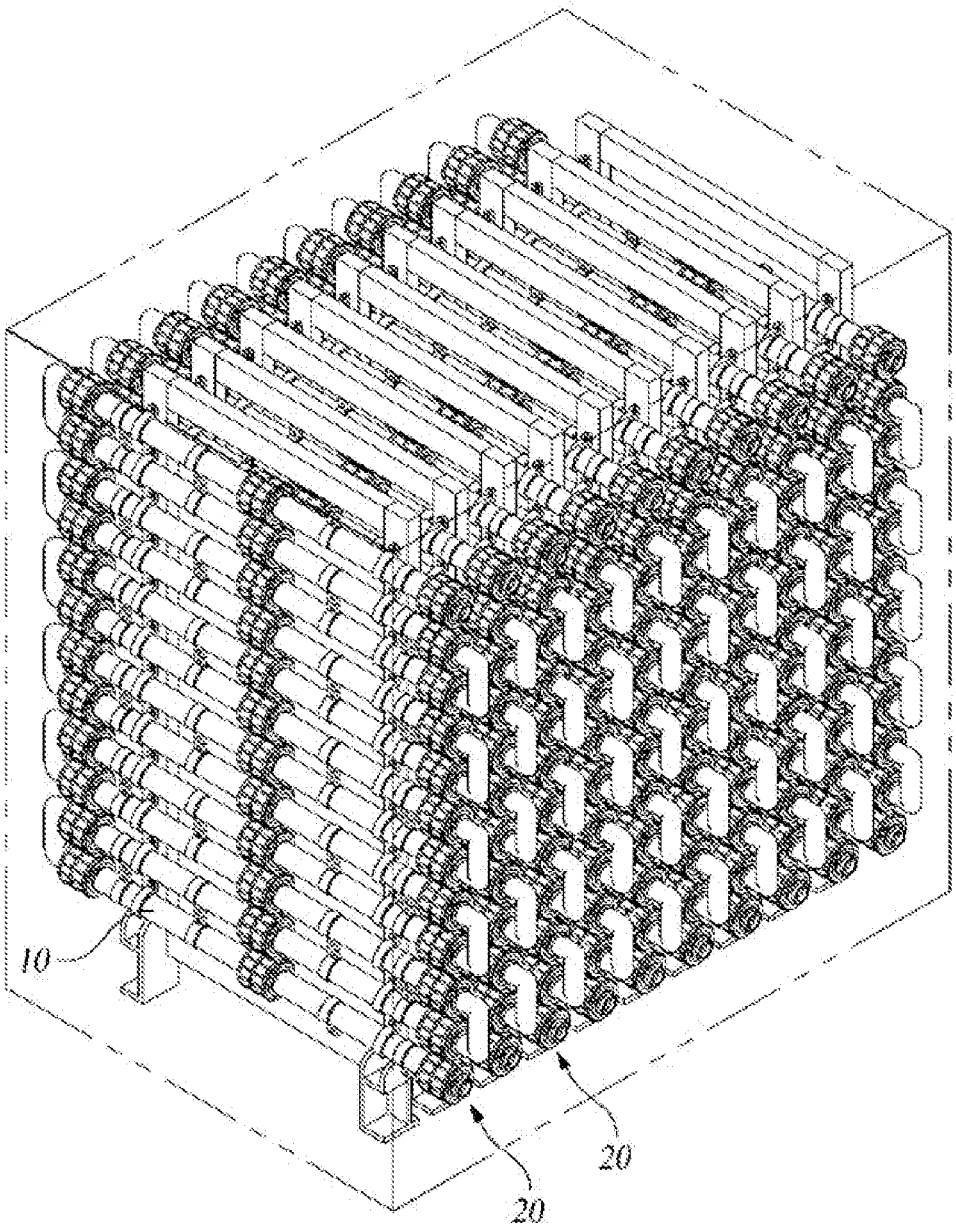
FIG. 2 is a perspective view of a conventional large-capacity electrolysis module.
Figure 3:
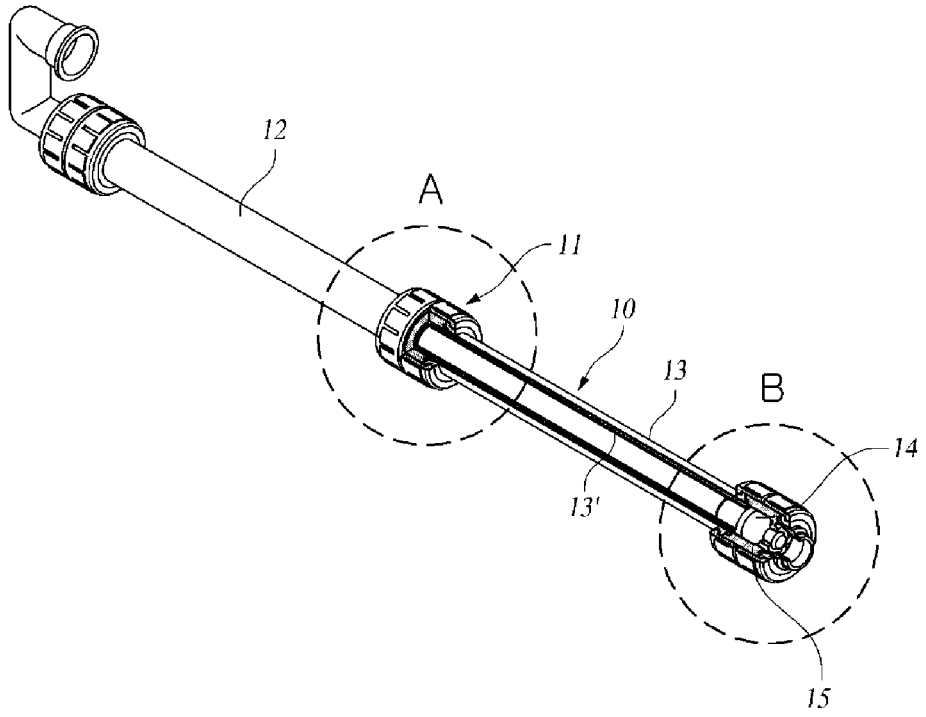
FIG. 3 is a perspective view of a conventional pipe-type electrolysis cell.
Figure 4:
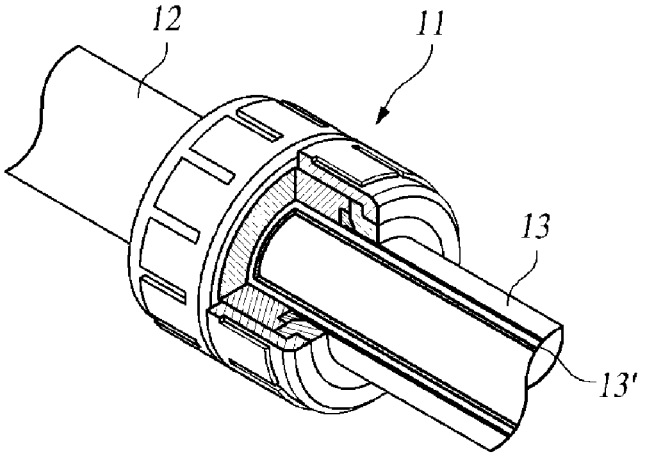
FIG. 4 is an expanded view of a portion A of FIG. 3.
Figure 5:
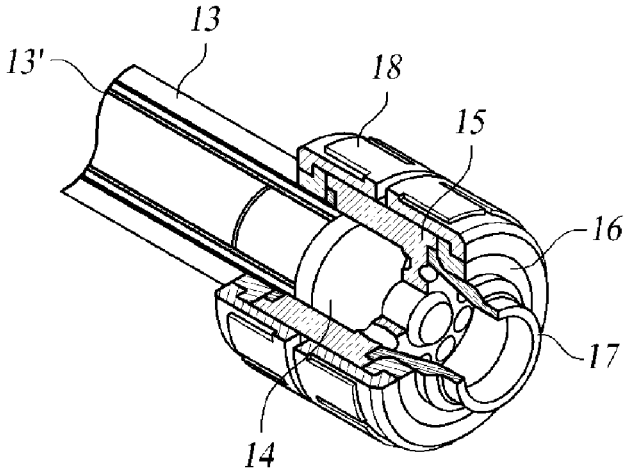
FIG. 5 is an expanded view of a portion B of FIG. 3.
Figure 6:
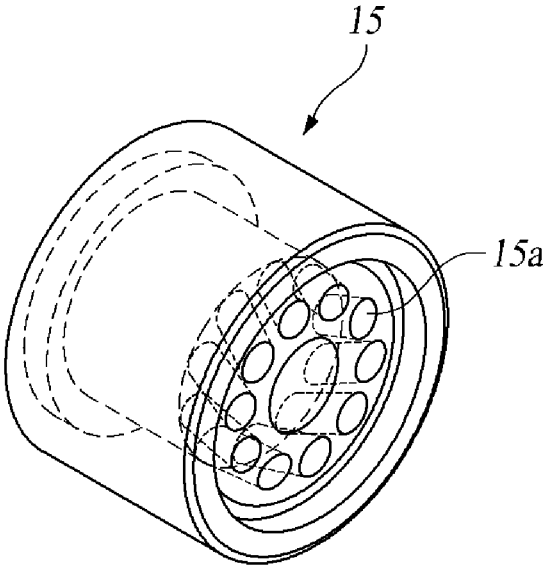
FIG. 6 is a perspective view illustrating a spiral block shown in FIG. 5.
Figure 7:
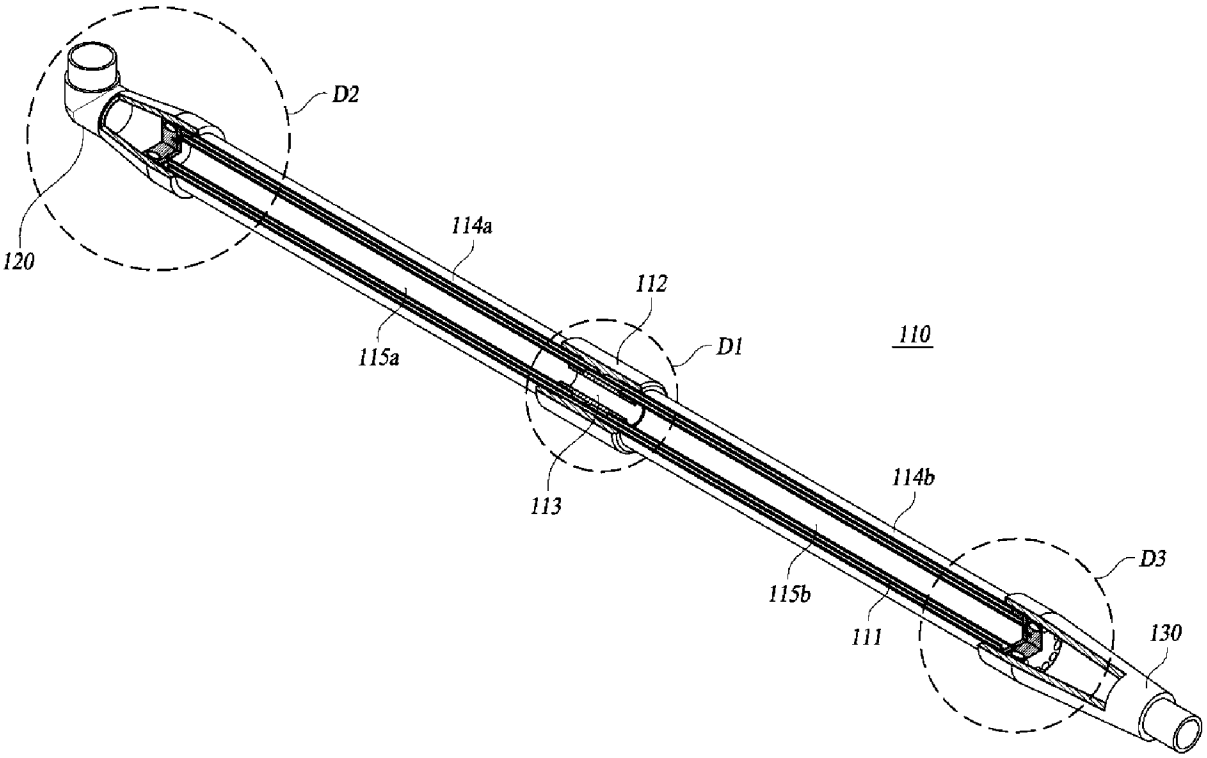
FIG. 7 is a perspective view of a pipe-type electrolysis cell according to one embodiment of the invention.
Figure 8:
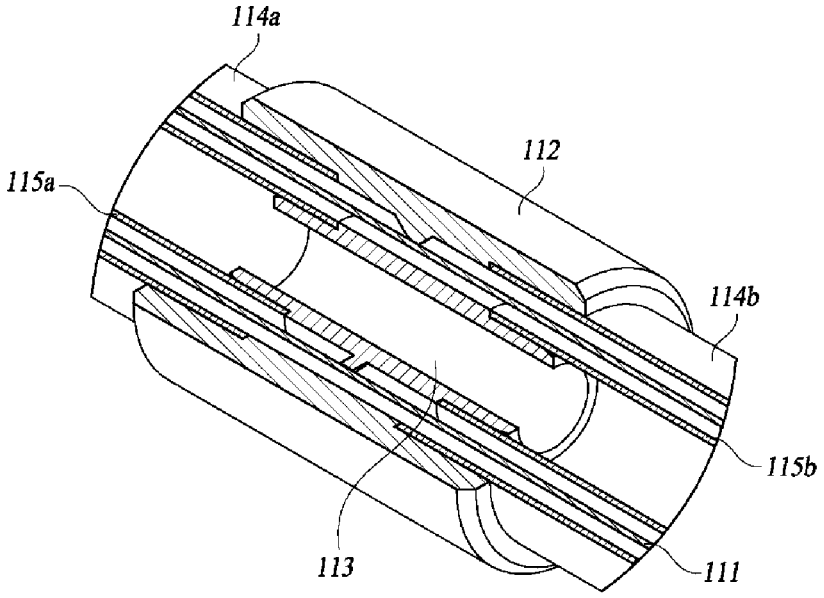
FIG. 8 is an expanded view of a portion D1 of FIG. 7.
Figure 9:
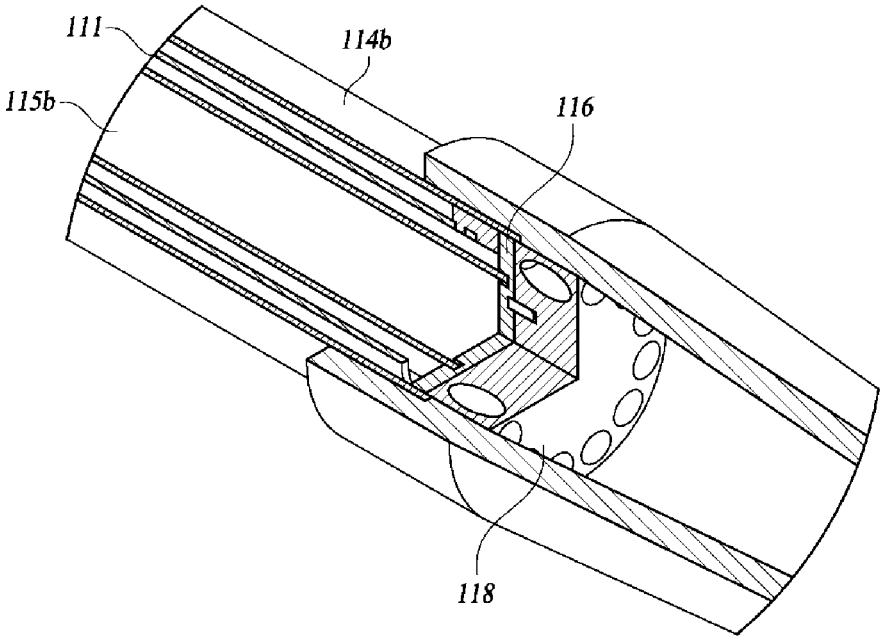
FIG. 9 is an expanded view of a portion D2 of FIG. 7.
Figure 10:
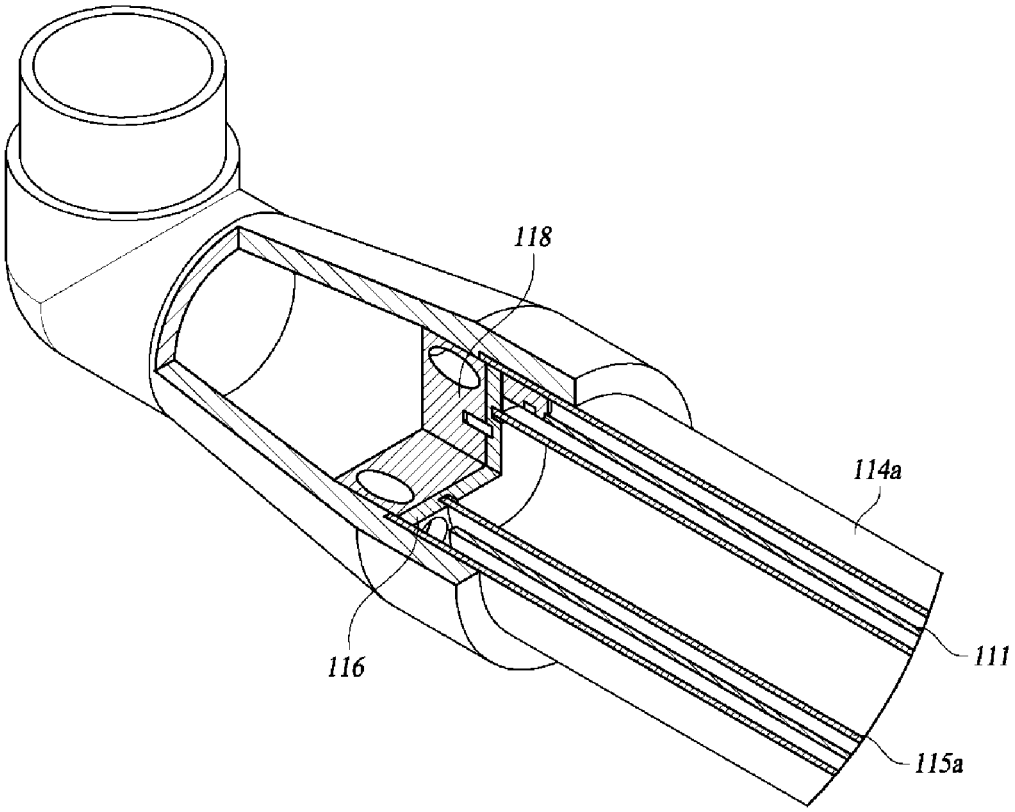
FIG. 10 is an expanded view of a portion D3 of FIG. 7.

Hereinbelow, a pipe-type electrolysis cell according to one embodiment of the invention will be described with reference to the accompanying drawings.

With reference to FIGS. 7 to 16, according to one embodiment of the invention, an electrolysis unit module includes a pipe-type electrolysis cell 110, a connection pipe 120 connected to an end of the pipe-type electrolysis cell 110, and an inlet/outlet connection nipple 130 combined with a second end of the pipe-type electrolysis cell 110.

The pipe-type electrolysis cell 110 according to one embodiment invention includes a pair of terminal electrodes, a bipolar electrode, an insulation unit, and a spiral block 118.

Herein, the pair of terminal electrodes includes inner electrodes 115*a* and 115*b*, outer electrodes 114*a* and 114*b*, and connection plates 116 by which first ends of the inner electrodes 115*a* and 115*b* are electrically connected to first ends of the outer electrodes 114*a* and 114*b*.

The bipolar electrode includes a pipe-type middle electrode 111 installed between the inner electrodes 115*a* and 115*b* and the outer electrodes 114*a* and 114*b*.

Figure 11:
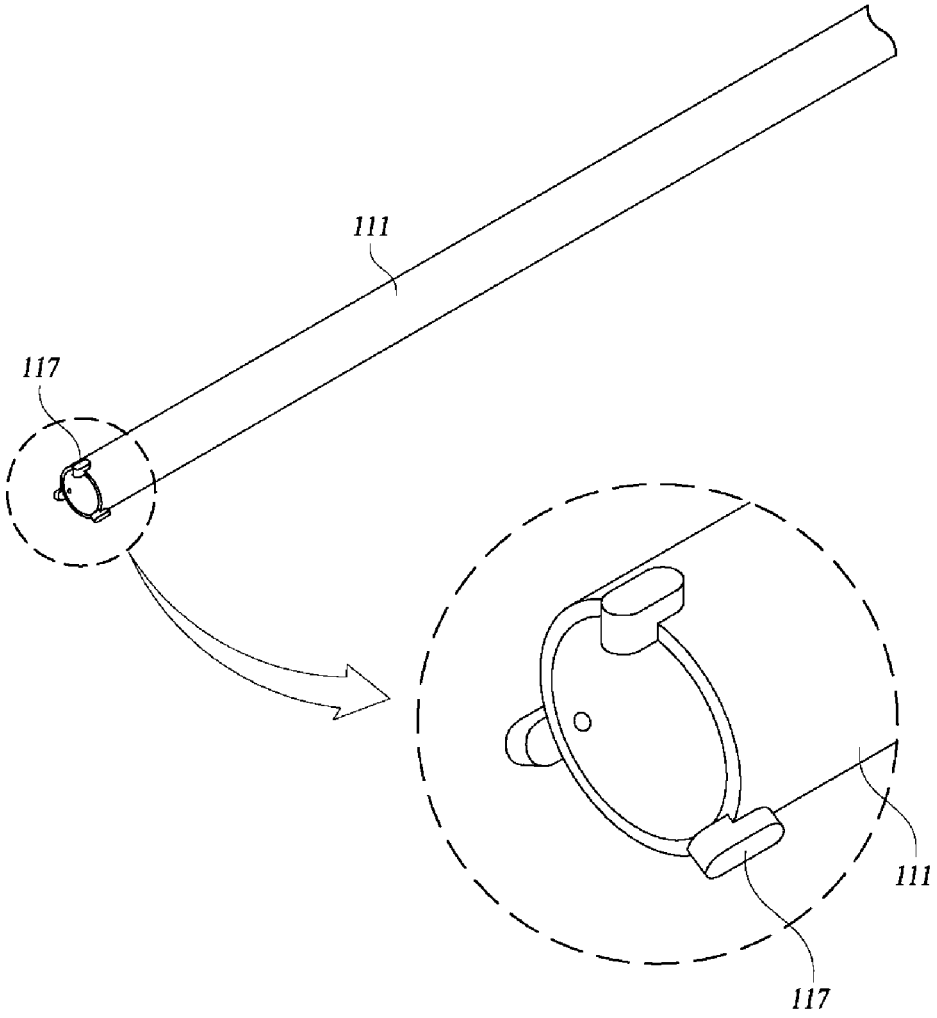
FIG. 11 is a perspective view illustrating a middle electrode of the pipe-type electrolysis cell shown in FIG. 7.
Figure 12:
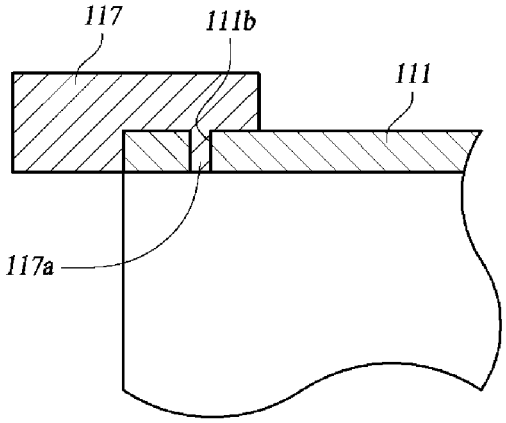
FIG. 12 is a cross-sectional view illustrating a main portion of the structure of FIG. 11.
Figure 13:
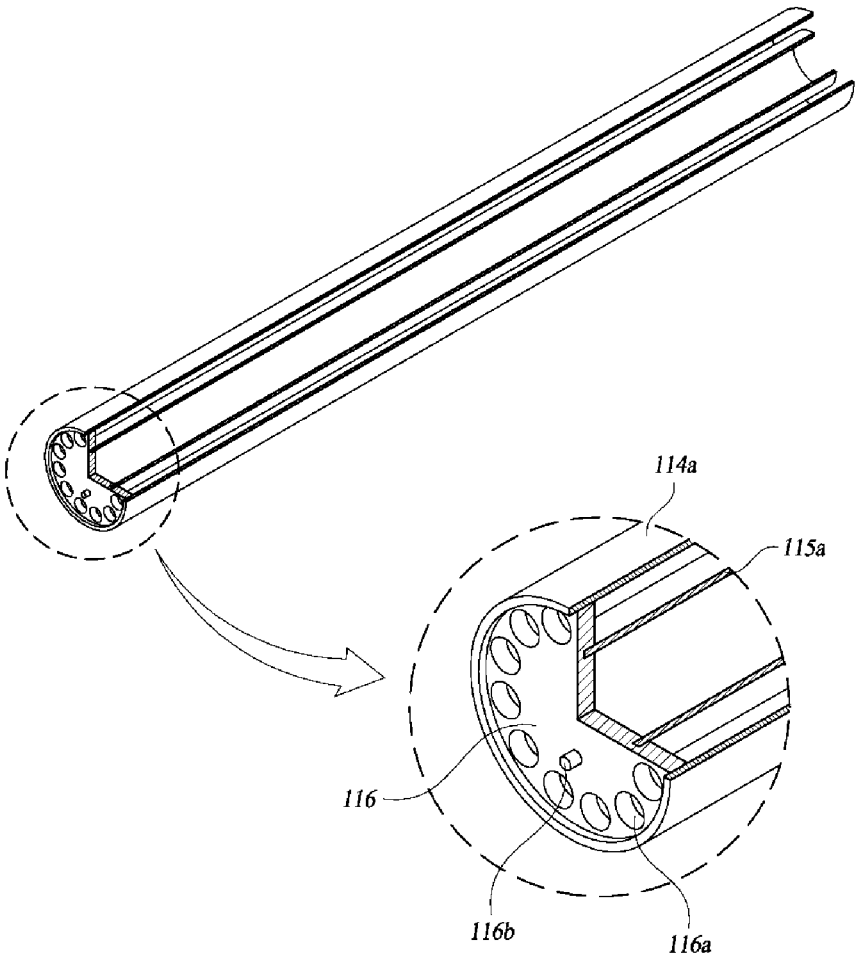
FIG. 13 is a diagram illustrating a connection portion at which an outer electrode and an inner electrode are connected to each other.
Figure 14:
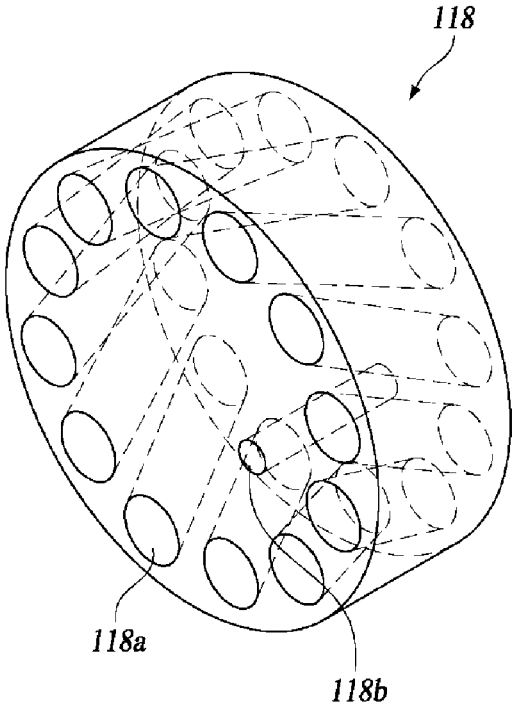
FIG. 14 is a diagram illustrating an outer insulating spacer of FIG. 7.

That is, the middle electrode 111 is a bipolar electrode having opposite polarities at opposite sides thereof. As shown in FIGS. 11 and 12, each end of the middle electrode 111 is provided with insulating terminal spacers 117. Specifically, each end of the middle electrode 111 is provided with three insulating terminal spacers 117. The three insulating terminal spacers 117 may be arranged at an equal angular interval of 120° C. However, the number and interval of the insulating terminal spacers 117 are not limited thereto. More specifically, the insulating terminal spacers 117 may be provided to protrude outward from an end of the middle electrode 111 in a longitudinal direction and from the outside surface of the middle electrode 111. To this end, each insulating terminal spacer 117 is provided with a coupling pin 117*a* to be fitted into a coupling hole 111*b* provided at an end portion of the middle electrode 111. Due to the insulating terminal spacers 117, the middle electrode 111 can be spaced from the outer electrodes 114*a* and 114*b* and from the connection plates 116, by a predetermined distance. Therefore, the middle electrode 111 can be electrically insulated from the outer electrodes and the connection plates. The shape of the insulating terminal spacers 117 is not limited to the structure described above. That is, the insulating terminal spacers 117 can have any shape if they can space the middle electrode 111 from the outer electrodes 114*a* and 114*b* and the connection plates 116, thereby electrically insulating the middle electrode 111 from the outer electrodes 114*a* and 114*b* and the connection plates 116. However, as to the structure of the insulating terminal spacers 117, there is a further requirement that it should not block an electrolyte solution that is introduced into a channel formed between the electrodes through fluid passing holes formed in the connection plates 116.

The insulation unit includes an outer insulating spacer 112 installed outside the middle electrode 111, at a middle portion of the middle electrode 111 in a longitudinal direction thereof, and an inner insulating spacer 113 installed inside the middle portion at the middle portion. A further detailed description of the insulation will be given later.

Figure 15:
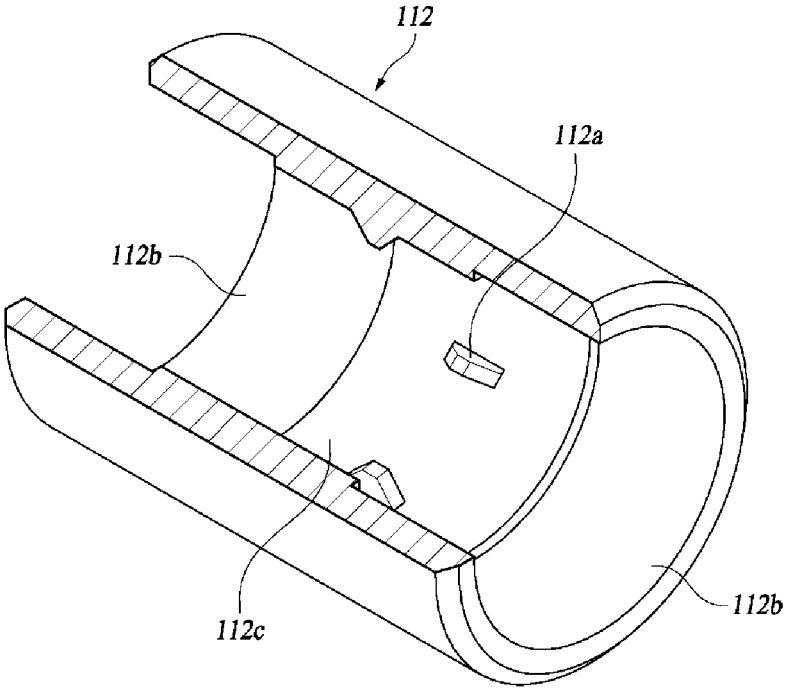
FIG. 15 is a diagram illustrating an inner insulating spacer of FIG. 7.
Figure 16:
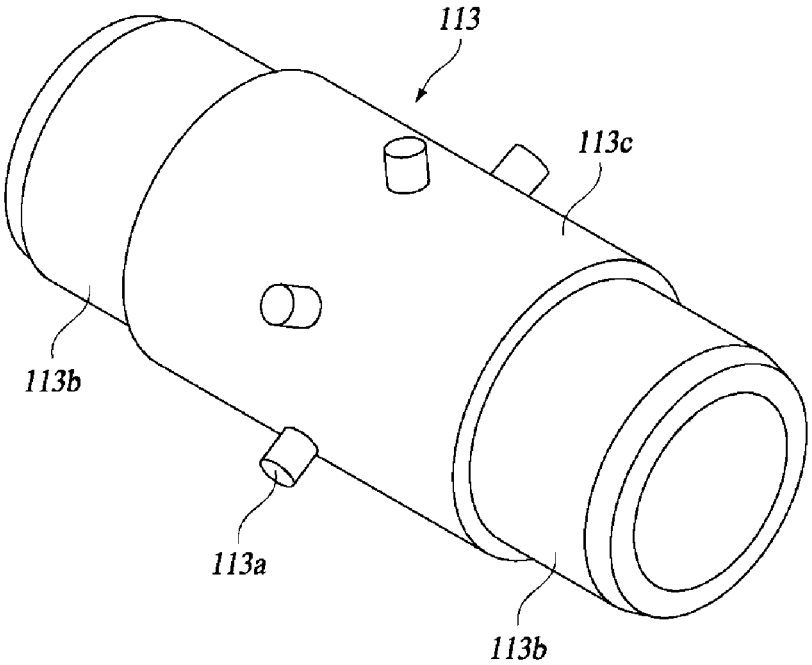
FIG. 16 is a diagram illustrating a spiral block of FIG. 7.

The outer electrodes 114*a* and 114*b* have a pipe shape. One outer electrode (114*a*) of the outer electrodes serves as a cathode and the other outer electrode (114*b*) serves as an anode. The outer insulating spacer 112 is provided between the outer electrode 114*a* and the outer electrode 114*b* to electrically insulate the outer electrodes 114*a* and 114*b* from each other and spaces the outer electrodes 114*a* and 114*b* from the middle electrode 111. As illustrated in FIG. 15, a middle portion of the inside surface of the outer insulating spacer 112 is provided with protrusions 112*a* which enable the inside surface of the outer insulating spacer 112 to be spaced from the outside surface of the middle electrode 111 by a predetermined distance. The protrusions 112*a* may be arranged at regular intervals in the circumferential direction of the outer insulating spacer 112 and are in surface contact with the outside surface of the middle electrode 111. Respective ends of the outer insulating spacer 112 are provided with outer electrode connection portions 112*b* into which end portions of the outer electrodes 114*a* and 114*b* are inserted, in which the outer electrode connection portions 112*b* have an inner diameter larger than an inner diameter of the middle portion of the outer insulating spacer 112. That is, the inside surface of the electrode connection portion 112*b* and the inside surface of the middle portion of the insulating outer spacer 112 form a step shape. Therefore, the outer electrodes 114*a* and 114*b* are supported on and insulated from each other by the outer insulating spacer 112.

As described above, adjacent ends (second ends) of the outer electrodes 114*a* and 114*b* are assembled with the outer insulating spacer 112, and the other ends (first ends) are respectively assembled with the connection pipes 120 or the inlet/outlet connection nipples 130.

In addition, the first ends of the outer electrodes 114*a* and 114*b* are connected to first ends of the inner electrodes 115*a* and 115*b* by the connection plates 116. The connection plates 116 are made of a metal. The first ends of the inner electrodes 115*a* and 115*b* and the first ends of the outer electrodes 114*a* and 114*b* are connected through a connection method such as welding that does not increase electrical resistance. Therefore, as to the inner electrodes 115*a* and 115*b* and the outer electrodes 114*a* and 114*b* connected by the connection plate 116, the outer electrode 114*a* and the inner electrode 115*a*, connected to each other, have the same polarity (i.e. both serving as a cathode) and the outer electrode 114*b* and the inner electrode 115*b* have the same polarity (i.e. both serving as an anode).

The inner insulating spacer 113 is provided between the inner electrodes 115*a* and 115*b*, so that the inner electrodes 115*a* and 115*b* are electrically insulated from each other by the inner insulating spacer 113. The inner insulating spacer 113 also spaces and electrically insulates the inner electrodes 115*a* and 115*b* from the middle electrode 111.

Herein, the inner insulating spacer 113 is installed at a middle portion inside the middle electrode 111 and is provided with a plurality of protrusions 113 on the outside surface thereof. The protrusions 113*a* protrude from the outside surface 113 of the inner insulating spacer 113 and are arranged at regular intervals in the circumferential direction. The protrusions 113 are in contact with the inside surface of the middle electrode 111. Respective ends of the inner insulating spacer 113 are provided with inner electrode connection portions 113*b* that have a smaller outer diameter than that of a middle portion 113*c* of the inner insulating spacer 113 such that the outside surface of the inner electrode connection portion 113*b* and the outside surface of the middle portion 113*c* of the inner insulating spacer 113 form a step shape. Therefore, the inner electrode connection portions 113*b* of the inner insulating spacer 113 can be respectively inserted into the adjacent ends of the inner electrodes 115*a* and 115*b*. The inner insulating spacer 113 supports the inner electrodes 115*a* and 115*b* while electrically insulating the inner electrodes 115*a* and 115*b* from each other, and also spaces and electrically insulates the inner electrodes 115*a* and 115*b* from the middle electrode 111.

The structures of the outer insulating spacer 112 and the inner insulating spacer 113 are not limited to those described above. The outer insulating spacer 112 and the inner insulating spacer 113 may have any structure that can meet requirements that the outer electrodes 114*a* and 114*b* can be supported in a state of being electrically insulated from each other, the inner electrodes 115*a* and 115*b* can be supported in a state of being electrically insulated from each other, and the outer electrodes and the inner electrodes can be spaced and electrically insulated from the middle electrode 111 by a predetermined distance. In this case, the protrusions 112*a* of the outer insulating spacer 112 and the protrusions 113*a* of the inner insulating spacer 113, which are provided to space and electrically insulate the outer electrodes and the inner electrodes from the middle electrode 111, are preferably configured not to impede the flow of an electrolyte solution which flows along a channel provided between the outer electrode and the middle electrode and a channel provided between the inner electrode and the middle electrode.

According to the structure described above, power is oppositely supplied to the bipolar electrode, i.e. the pipe-type middle electrode 11, which is disposed between and spaced from the outer electrodes 114*a* and 114*b* and the inner electrodes 115*a* and 115*b*, with respect to the outer electrodes 114*a* and 114*b* and the inner electrodes 115*a* and 115*b*. Accordingly, an electrolytic reaction occurs in a state in which a fluid flows along the outside surface and the inside surface of the middle electrode 111. Since the electrolytic reaction occurs while the fluid is flowing along the outside surface and the inside surface of the middle electrode 111, the pipe-type electrolysis cell of the present invention exhibits electrolysis performance that is twice or more than that of conventional pipe-type electrolysis cells. That is, with the same volume as a conventional pipe-type electrolysis cell, the pipe-type electrolysis cell of the invention can obtain two times higher electrolysis efficiency than the conventional pipe-type electrolysis cell. Since those skilled in the art can easily understand the detailed structure and operation of the pipe-type electrolysis cell, there will be no further description thereof.

In addition, the connection plate 116 is provided with a plurality of fluid passing holes 116*a* that are equal in size and are arranged at regular intervals in a circumferential direction of the connection plate 116 such that the fluid can be introduced into a gap between the inner electrodes 115*a* and 115*b* and the outer electrodes 114*a* and 114*b*. In addition, one or more positioning guide pins 116*b* are formed to protrude from the outside surface of the connection plate 116. The positioning guide pins 116*b* are configured to enable a combined structure of the electrodes to be precisely and accurately aligned with the spiral block 118 when the combined structure of the electrodes is combined with the spiral block.

In addition, the connection plate 116 may be made of a plurality of plates arranged in multiple stages. In this case, the plates are stacked such that the fluid passing holes provided to each plate are misaligned. That is, a fluid path extending through the fluid passing holes of the plates may form a spiral shape. Alternatively, each fluid passing hole 116*a* may extend in a spiral form in the connection plate 116, thereby guiding the fluid along a spiral flow path.

The spiral block 118 is connected to the outside surface of the connection plate 116. The spiral block 118 is provided with a plurality of spiral guide holes 118*a* that are arranged at intervals in a circumferential direction of the spiral block 118. Since the fluid spirally flows while passing through the spiral guide holes 118*a*, velocity distribution of the fluid can be uniformized. In addition, the spiral block 118 is provided with a positioning hole 118*b* that is used to position the spiral block 118 such that the guide holes 118*a* of the spiral block 118 can be precisely and accurately aligned with the fluid passing holes 116*a* of the connection plate 116 when the spiral block 118 is connected to the connection plate 116. When the positioning guide pin 116*b* of the connection plate 116 is inserted into the positioning hole 118*b*, the fluid passing holes 116*a* are automatically aligned with the guides hole 118*a*. Therefore, the fluid can flow without flow resistance. The spiral block 118 is assembled with the connection pipe 120 or the inlet/outlet connection nipple 130.

In addition, as to the middle electrode 111, a half of each of the outside surface and the inside surface in terms of the longitudinal direction is coated with an anode material. That is, both of the outside surface and the inside surface of the middle electrode 111 can be used for an electrolytic reaction unlike conventional arts. Therefore, electrolysis capacity is doubled.

In addition, among the terminal electrodes, the outer electrode 114*a* serving as the cathode and the inner electrode 115*a* serving as the cathode are made of stainless steel or nickel alloys. The outer electrode 114*a* and the inner electrode 115*a* serving as the cathode are connected to the connection plate 116 through a connection method such as welding that does not increase electric resistance. In addition, one or more surfaces of the electrodes, which do not participate in an electrolytic reaction while the electrolyte solution flows, for example, the inside surface of the inner electrode 115*a* or the outside surface of the outer electrode 114*a*, are preferably coated with a metal having a high electric conductivity, which uniformly distributes current intensity over the entire length of the electrode during the electrolytic reaction. For this reason, uniformity and efficiency of the electrolytic reaction can be improved compared with conventional multi-stage electrolytic cells, and heat generated during the electrolytic reaction can be controlled.

In addition, among the terminal electrodes, the outer electrode 114*b* and the inner electrode 115*b* serving as the anode are made of titanium. The inside surface of the outer electrode 114*a* and the outside surface of the inner electrode 115*b* are coated with a platinum oxide to form insoluble electrodes. Furthermore, these electrodes are plated and welded in the same manner as the electrodes serving as the cathode described above, thereby maintaining the electrical conductivity.

A plurality of pipe-type electrolysis cells 110 having the structure described above are arranged in series, and adjacent ends thereof are connected to each other by the connection pipe 120 so that a fluid can flow from one cell to another.

In addition, among the plurality of pipe-type electrolysis cells 110, the outermost electrolysis cells 110 are connected to the inlet/outlet connection nipples 130. That is, outer ends of both of the outermost pipe-type electrolysis cell 110 are connected to the connection pipes 120 or the inlet/outlet connection nipples 130.

Alternatively, the outer end of one of the outermost pipe-type electrolysis cells 110 may be connected to the connection pipe 120 and the outer end of the other of the outermost pipe-type electrolysis cells 110 may be connected to the inlet/outlet connection nipple 130.

Figure 17A:
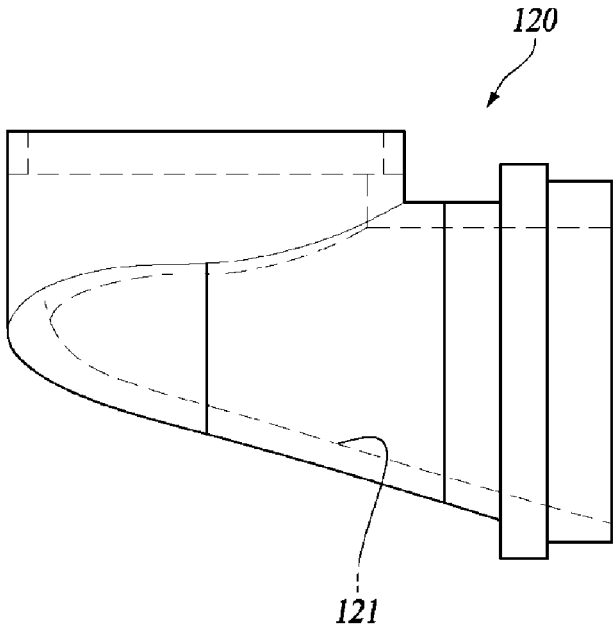
FIG. 17A is a diagram illustrating an example of a connection pipe.
Figure 17B:
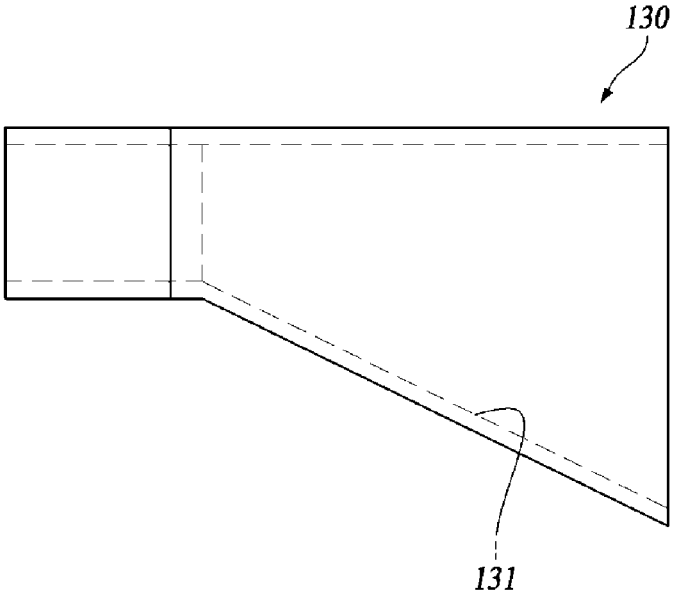
FIG. 17B is a diagram illustrating an example of an inlet/outlet connection nipple.

In at least either one of the connection pipe 120 and the inlet/outlet connection nipple 130, an internal fluid channel, i.e. fluid passage channel, has a tapered form so that movement of fluid and separation of hydrogen are facilitated. That is, the connection pipe 120 and/or the inlet/outlet connection nipple 130 have bottom surfaces 121 and 131 that are sloped upward toward the outer ends thereof as shown in FIGS. 17A and 17B.

As described above, an electrolysis unit module 100 is made up of the plurality of pipe-type electrolysis cells 110 connected in series with each other.

As described above, the pipe-type electrolysis cell 110 according to the embodiment of the invention is structured such that the pipe-type bipolar electrode (i.e. middle electrode) is arranged between the terminal electrodes consisting of the outer electrode and the inner electrode, thereby enabling the electrolytic reaction to occur on both the inside surface and the outside surface of the bipolar electrode. In this way, an amount of electrolytic reactions that was performed by two conventional electrolysis modules can be performed by one electrolysis module. That is, according to the present invention, the pipe-type electrolysis cell can obtain an electrolysis performance equal to that of a conventional pipe-type electrolysis cell even while being only half the size. In addition, according to the invention, the amount of electrode material is reduced to about 65%, and the amount of epoxy molding material and the amount of frames are also reduced by about 50%. That is, the pipe-type electrolysis cell of the invention is considerably more cost effective because it is possible to reduce the size and the material cost while maintaining electrolysis capacity.

In the case in which an electrolysis module made up of the pipe-type electrolysis cells having the structure described above is applied to a ship, it can be installed in old ships as well as new ships because it requires a reduced installation space.

The pipe-type electrolysis cell of the present invention can be applied to an electrolysis apparatus that can electrolyze general water such as flesh water as well as an electrolysis apparatus that electrolyzes sea water, salt water, and so on.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

The invention claimed is:

1. A pipe-type electrolysis cell, comprising:

a first pair of terminal electrodes including a first outer electrode and a first inner electrode that are electrically connected to each other at respective first ends thereof and separated from each other at respective second ends thereof;

a second pair of terminal electrodes including a second outer electrode and a second inner electrode that are electrically connected to each other at respective first ends thereof and separated from each other at respective second ends thereof;

a pipe-type bipolar electrode installed between the terminal electrodes and electrically insulated from the terminal electrodes; and an insulation unit disposed between the second ends of the first pair of terminal electrodes and the second ends of the second pair of terminal electrodes, the insulation unit including at least an inner insulating spacer provided inside the bipolar electrode at a middle portion in a longitudinal direction.

2. The pipe-type electrolysis cell according to claim 1, further comprising a spiral block combined with the connected first ends of the first pair of terminal electrodes and provided with a spiral guide hole through which a fluid passes.

3. The pipe-type electrolysis cell according to claim 2, wherein the insulation unit further comprises an outer insulating spacer provided on an outside surface of the bipolar electrode at the middle portion in the longitudinal direction.

4. The pipe-type electrolysis cell according to claim 3, wherein the outer insulating spacer comprises:

a plurality of protrusions formed on an inside surface thereof and arranged at regular intervals in a circumferential direction thereof, at a middle portion in a longitudinal direction of the outer insulating spacer, the protrusions being in contact with the outside surface of the bipolar electrode; and a pair of electrode connection portions that are provided at respective ends thereof and are each configured to receive the outer electrodes inserted therein, the electrode connection portions having an inner diameter larger than that of the middle portion of the outer insulating spacer such that an inside surface of the electrode connection portion and an inside surface of the middle portion of the outer insulating spacer form a step shape.

5. The pipe-type electrolysis cell according to claim 4, wherein the first and the second outer electrodes are positioned within the pair of electrode connection portions.

6. The pipe-type electrolysis cell according to claim 3, wherein the inner insulating spacer comprises:

a plurality of protrusions arranged at the middle portion of the bipolar electrode in the longitudinal direction, arranged at regular intervals in a circumferential direction, and formed to protrude from an outside surface of the inner insulating spacer; and a pair of electrode connection portions provided at respective ends thereof and having an outer diameter smaller than that of a middle portion of the inner insulating spacer such that an outside surface of the electrode connection portion and the outside surface of the middle portion of the inner insulating spacer form a step form, in which each of the electrode connection portions are configured to be inserted into the inner electrodes.

7. The pipe-type electrolysis cell according to claim 6, wherein the pair of electrode connection portions are positioned within the first and the second inner electrodes.

8. The pipe-type electrolysis cell according to claim 1, wherein the first pair of terminal electrodes include a connection plate that supports and connects the first ends of the first inner electrode and the first outer electrode, and which is provided with a fluid passing hole communicating with a channel formed between the first inner electrode and the first outer electrode, thereby guiding a fluid to the channel.

9. The pipe-type electrolysis cell according to claim 8, wherein the insulation unit includes one or more additional terminal insulating spacers provided to respective ends of the bipolar electrode to electrically insulate and space the bipolar electrode from the connection plate, the inner electrodes, and the outer electrodes.

10. The pipe-type electrolysis cell according to claim 8, wherein the connection plate provided with the fluid passing hole, and the first outer and inner electrodes are connected through welding.

11. The pipe-type electrolysis cell according to claim 8, wherein the fluid passing holes formed in the connection plate are aligned with spiral guide holes formed in a spiral block.

12. The pipe-type electrolysis cell according to claim 8, further comprising a spiral block, wherein a positioning guide pin is formed to protrude from an outside surface of the connection plate, the spiral block is combined with the outside surface of the connection plate, and the spiral block is provided with a plurality of spiral guide holes that are arranged in a circumferential direction so as to correspond to the fluid passing holes of the connection plate.

13. The pipe-type electrolysis cell according to claim 12, wherein the spiral block is provided with a positioning hole into which the positioning guide pin is inserted when the spiral block is combined with the connection plate such that the spiral guide holes are substantially aligned with the fluid passing holes of the connection plate.

14. The pipe-type electrolysis cell according to claim 8, wherein the insulation unit connects the separated second ends of the terminal electrodes to each other; and wherein a spiral block is combined with the connected first ends of the first pair of terminal electrodes and is provided with a spiral guide hole through which a fluid passes.

15. The pipe-type electrolysis cell according to claim 14, wherein the insulation unit further comprises an outer insulating spacer provided on an outside surface of the bipolar electrode at the middle portion in the longitudinal direction.

16. The pipe-type electrolysis cell according to claim 1, wherein either one or both of an outside surface of the outer electrodes having a pipe shape and an inside surface of the inner electrodes having a pipe shape are plated with a metal having a high electrical conductivity, wherein the outside surface and the inside surface are not involved in an electrolytic reaction.

17. The pipe-type electrolysis cell according to claim 1, further comprising: a connection pipe or an inlet/outlet connection nipple combined with the first ends of the first or second pair of terminal electrodes, and configured to connect the pipe-type electrolysis cell to a second pipe-type electrolysis cell, wherein the connection pipe or the inlet/outlet connection nipple is structured such that a bottom surface thereof is sloped upwards toward an end of the connection pipe or the inlet/outlet connection nipple.

18. A pipe-type electrolysis cell, comprising:

a pair of terminal electrodes including an outer electrode and an inner electrode that are electrically connected to each other at respective first ends thereof and separated from each other at respective second ends thereof;

a pipe-type bipolar electrode installed between the terminal electrodes and electrically insulated from the terminal electrodes; and an insulation unit supporting the separated second ends of the terminal electrodes, the insulation unit including an outer insulating spacer provided on an outside surface of the bipolar electrode at a middle portion in a longitudinal direction and an inner insulating spacer provided inside the bipolar electrode at the middle portion in the longitudinal direction;

wherein the outer insulating spacer includes a plurality of protrusions formed on an inside surface thereof and arranged at regular intervals in a circumferential direction thereof, at a middle portion in a longitudinal direction of the outer insulating spacer, the protrusions being in contact with the outside surface of the bipolar electrode, and the outer insulating spacer includes a pair of electrode connection portions provided at respective ends thereof and having an outer diameter smaller than that of a middle portion of the inner insulating spacer such that an outside surface of the electrode connection portion and the outside surface of the middle portion of the inner insulating spacer form a step form, in which one of the electrode connection portions is inserted into the inner electrode.

19. The pipe-type electrolysis cell according to claim 18, wherein the inner insulating spacer comprises:

a plurality of protrusions arranged at a middle portion of the bipolar electrode in a longitudinal direction, arranged at regular intervals in a circumferential direction, and formed to protrude from an outside surface of the inner insulating spacer; and a pair of electrode connection portions provided at respective ends thereof and having an outer diameter smaller than that of the middle portion of the inner insulating spacer such that an outside surface of the electrode connection portion and the outside surface of the middle portion of the inner insulating spacer form a step form, in which each of the electrode connection portions are configured to be inserted into the inner electrode.

20. The pipe-type electrolysis cell according to claim 18, further comprising a connection pipe or an inlet/outlet connection nipple combined with the first ends of the terminal electrodes, and configured to connect the pipe-type electrolysis cell to a second pipe-type electrolysis cell, wherein the connection pipe or the inlet/outlet connection nipple is structured such that a bottom surface thereof is sloped upwards toward an end of the connection pipe or the inlet/outlet connection nipple.

* * * * *